US005285557A

United States Patent [19]

Schriever

[11] Patent Number: 5,285,557

[45] Date of Patent: Feb. 15, 1994

[54] SNAP FASTENER AND TOOLING THEREFOR

[75] Inventor: Frederick G. Schriever, Grosse Pointe Shores, Mich.

[73] Assignee: SnapFast Industries, Inc., Detroit, Mich.

[21] Appl. No.: 36,551

[22] Filed: Mar. 24, 1993

Related U.S. Application Data

[63] Continuation of Ser. No. 765,437, Sep. 25, 1991, abandoned.

[51] Int. Cl.[5] ..... A44B 17/00; A41F 1/00

[52] U.S. Cl. ..... 24/662; 24/113 MP; 24/624

[58] Field of Search ..... 24/662, 621, 624, 453, 24/113 MP, 324; 411/107, 111, 112, 113

[56] References Cited

U.S. PATENT DOCUMENTS

| | | | |
|---|---|---|---|
| 506,110 | 10/1893 | Hampel . | |
| 681,086 | 8/1901 | Washburne . | |
| 717,333 | 12/1902 | Brigham . | |
| 991,156 | 5/1911 | Kerngood . | |
| 1,096,897 | 5/1914 | Fisher . | |
| 1,204,173 | 11/1916 | McMeekin . | |
| 1,302,918 | 5/1919 | Harris . | |
| 1,652,139 | 12/1927 | Elwell . | |
| 1,858,440 | 5/1932 | Fenton . | |
| 2,099,979 | 11/1937 | Bangs . | |
| 2,328,016 | 8/1943 | Huelster . | |
| 2,632,222 | 3/1953 | Becker . | |
| 2,668,340 | 2/1954 | Jones . | |
| 2,709,290 | 5/1955 | Rosenthal . | |
| 2,807,069 | 7/1959 | Jansson . | |
| 2,895,199 | 7/1959 | Jones . | |
| 2,990,595 | 7/1961 | Van Buren, Jr. | 24/662 |
| 3,249,974 | 5/1966 | Connolly | 24/113 MP |
| 4,109,845 | 8/1978 | Wedge et al. . | |
| 4,153,792 | 8/1978 | Stickle | 24/662 |
| 4,409,706 | 10/1983 | Clendinen | 24/662 |
| 4,539,735 | 9/1985 | Kasai | 24/621 |
| 4,562,624 | 1/1986 | Kanbaka | 24/621 |
| 4,596,349 | 6/1986 | Herten . | |
| 4,646,399 | 3/1987 | Clendinen | 24/624 |
| 5,050,279 | 9/1991 | Nemazi . | |

FOREIGN PATENT DOCUMENTS

| | | | |
|---|---|---|---|
| 0213940 | 10/1956 | Australia | 24/662 |
| 91282 | 2/1923 | Austria . | |
| 98040 | 4/1897 | Fed. Rep. of Germany . | |
| 450924 | 1/1912 | France . | |
| 2237592 | 2/1975 | France . | |
| 80821 | 9/1919 | Switzerland . | |
| 872204 | 1/1942 | United Kingdom . | |

*Primary Examiner*—Victor N. Sakran
*Attorney, Agent, or Firm*—Brooks & Kushman

[57] ABSTRACT

A snap fastener having a stud with a pear-shaped head has a grommet assembly for removable mounting on the stud with the grommet assembly comprising a metal tooth cap and an annular plastic retainer with the fabric squeezed therebetween and prongs of the cap extending through the fabric and clinched over the retainer, and with the head of the stud disposed between the cap and retainer and with the fabric extending uninterruptedly over the head of the stud. Tooling is shown for quickly assembling the tooth cap and retainer to the fabric.

27 Claims, 4 Drawing Sheets

SNAP FASTENER AND TOOLING THEREFOR

This is a continuation of copending application Ser. No. 07/765,437 filed on Sept. 25, 1991, now abandoned.

FIELD OF INVENTION

This invention relates to snap fasteners and tools for applying the same to fabrics and the like.

BACKGROUND OF THE INVENTION

This is a further development of the snap fasteners shown in U.S. Pat. Nos. 4,409,706, 4,577,376, 4,646,399 and U.S. application Ser. No. 07/382,666, filed Jun. 29, 1989, now U.S. Pat. No. 5,050,279, all of which are incorporated herein by reference. While the stud design disclosed in application Ser. No. 382,666 represents a satisfactory, operable design, field testing showed that variation in the inside diameter of the grommet aperture resulted in fasteners where the grommet and stud could not be readily snapped together or disconnected to fasteners where the grommet and stud were so loosely joined that they might easily and inadvertently separate. The variations in aperture diameter in the grommet were traced to two major causes: (1) the manner in which the artisan assembled the grommets to the fabric and (2) in use the grommets were being distorted beyond their elastic limit.

Various design changes were experimented with in an effort to provide a grommet with a reliable inside diameter and as shown in application Ser. No. 382,666 grommets with an internal ring incorporated therein were proposed. The following U.S. and foreign references were known and considered:

| U.S. Pat. Nos.: | Foregin Patents: |
|---|---|
| 506,110 | French Patent No. 450,924 |
| 681,086 | British Patent No. 872,204 |
| 717,333 | German Patent No. 98,040 |
| 991,156 | Austrian Patent No. 91,282 |
| 1,096,897 | Swiss Patent No. 80,821 |
| 1,204,173 | |
| 1,302,918 | |
| 1,652,139 | |
| 2,099,979 | |
| 2,328,016 | |
| 2,709,290 | |
| 2,807,069 | |
| 2,895,199 | |

I finally determined that the portion of the fastener to be snapped on the stud (hereinafter the retainer) had to have an aperture whose diameter was independent of the manner in which the fastener was attached to the fabric, and would not be distorted beyond its elastic limit when applied to or removed from the stud. I further determined that both the stud and the retainer should be made of plastic which could not corrode when exposed to corrosive environments and whose tolerances could be closely held.

Consideration was given to methods of attaching the retainer to the fabric including heat sealing as in U.S. Pat. No. 2,895,199, or gluing, or where the fabric was mechanically held as in U.S. Pat. No. 2,807,069. Each of these approaches held a variety of disadvantages.

An important consideration was ease of attachment of the fastener to the fabric material. Ideally the retainer should be attachable in a quick and simple fashion either manually using conventional tools or with setting tools usable in existing presses.

Similarly, the studs should be attachable to the fabric using conventional fasteners—where a fabric to fabric connection was desired, without the need for special adapters or modifications of the stud.

I determined the fastener should be so constructed that when assembled the plastic parts would be protected from the weather. While plastic materials might be selected containing ultraviolet inhibitors and good resistance to moisture, if the design was such that the plastic parts were substantially covered or shielded from the weather, the parts should function reliably and be aesthetically pleasing for a greater period of time.

Finally, I decided no hole should be required through the fabric for reception of the stud, as is required in the case of other commercially available fasteners such as the LIFT A DOT ® fastener manufactured by TRW or the twist type fastener manufactured by RAU Fasteners, Inc. of Providence, R.I. so that the fabric would not be weakened at the connection and would maintain maximum tear strength and integrity.

SUMMARY OF THE INVENTION

I have been able to attain all of the foregoing and other objectives with the fastener design disclosed herein. Several features brought together in a new combination have made this possible. Such features include the following:

(1) The retainer is an injection molded plastic part;

(2) The retainer has an aperture for snap reception over the stud with the tolerance variations of the diameter of the aperture being closely controllable during production;

(3) The diameter of the aperture of the retainer is independent of attachment of the retainer to the fabric;

(4) The retainer is designed to be attached to one side of the fabric and its shape is such that the stud head need not project through the fabric so the fabric may extend uninterruptedly over the stud, thus covering and protecting the stud and retainer from the weather and providing greater tear strength between the retainer and the fabric;

(5) A tooth cap of weather resistant stiffly deformable material such as stainless steel, is positioned on the opposite side of the fabric from the retainer and the teeth or prongs of the cap extend through the fabric and are clinched over and around the retainer to hold it to the fabric;

(6) The design of the tooth cap and the retainer are such that they may be assembled to the fabric with the very simplest of tools—a small hammer—or may be attached using special tools that are operable in a conventional bench press.

In accordance with a preferred embodiment, the tooth cap and retainer are polarized and the special tools used in the bench press are polarized to accept the cap and retainer in a particular orientation such that upon closing the press the cap prongs pierce the fabric and pass through the retainer and curl around and are clinched to the retainer whereby the retainer is joined to the fabric in a single smooth operation.

By selecting plastics which will resist weathering, and are dimensionally stable through the temperature and moisture conditions expected to be encountered during use, a fastener is thus provided which may be both readily connected and readily separated without the well-known "lock-up" of commercially available fasteners.

BRIEF DESCRIPTION OF PREFERRED EMBODIMENTS

Figure 1:
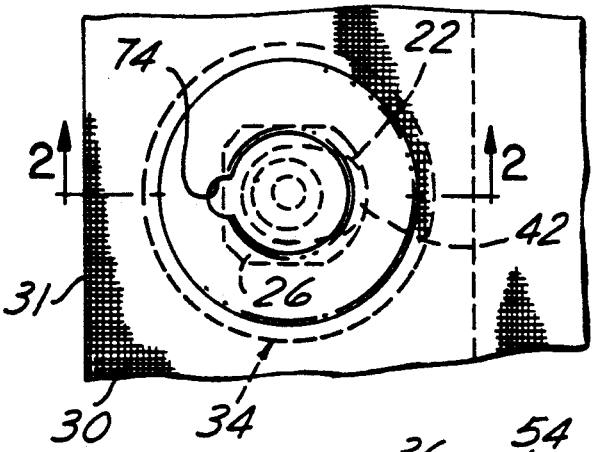
FIG. 1 is a top view of my improved snap fastener secured to the marginal edge of a fabric and mounted on a cooperating stud.

As shown in FIGS. 1, 2 and 4–8, my improved snap fastener comprises a stud 20 having a pear-shaped head 22, a shank 24 and a base 26 by which the shank is mounted to a support 28 to which a fabric 30 is to be secured by the fastener. The stud 20 is more fully disclosed in pending application Ser. No. 382,666, filed Jun. 28, 1989, now U.S. Pat. No. 5,050,279. A screw fastener member 32 is extended through a bore-in the stud and threaded into the support to retain the stud thereto. While a flat head screw is shown, other screw or bolt configurations may be utilized as desired to retain the stud to the support.

The fabric 30 is secured to the stud by a grommet assembly 34 comprising a tooth cap member 36 and a cooperating retainer member 38 between which is trapped the fabric 30. In general, the grommet assembly will be disposed at the marginal edge 40 of the fabric adjacent the fabric edge 31 so that such edge may be grasped to remove the grommet assembly and fabric from the stud. The pear-shaped head of the stud will be oriented on the support so that the nose 42 of the stud extends away from the marginal edge of the fabric and in the direction of the expanse of the fabric, which generally is the direction of the tension on the fabric.

Figure 4:
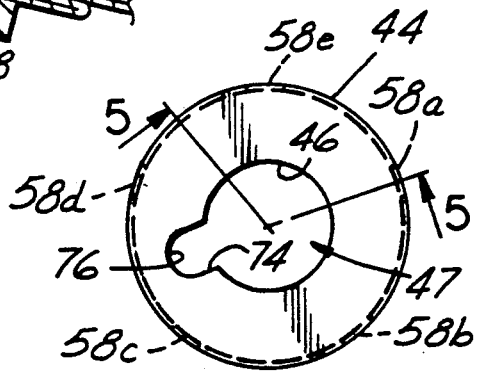
FIG. 4 is a top plan view of a tooth cap.

The tooth cap 36 is shown herein as being generally annular in plan view as shown in FIG. 4 having an outer peripheral edge 44 and an inner peripheral edge 46 defining a central essentially circular aperture 47, with an outer peripheral flange 48 at the outer periphery and an inner peripheral flange 50 at the inner periphery. These flanges extend substantially perpendicular to the plane of cap and serve to substantially strengthen and reinforce it. In addition, the flanges cooperatively serve to retain against displacement an identification disk 52 located on top of the fabric and within the cap and visible through aperture 47. This disk may have adhesive on one side so that it may be temporarily secured to the fabric by simply pressing it thereagainst. Such disks may serve to indicate the location of fasteners to be applied to the fabric when the canvas maker is mounting the fabric on the item to be covered, such as a boat, truck body, etc. The disk may be colored, such as red to identify the grommet assemblies of a boat cover located on the port side of a boat and green to indicate those on the starboard side. The disk may show identifying indicia, throughout the aperture 47, of the canvas maker using the fasteners or a boat manufacturer, truck manufacturer or the like. The disk may be the same color as the fabric on which the grommet assembly is being mounted simply to cover a hole in the fabric when the grommet assembly replaces a previous fastener which required a hole through the fabric.

Figure 5:
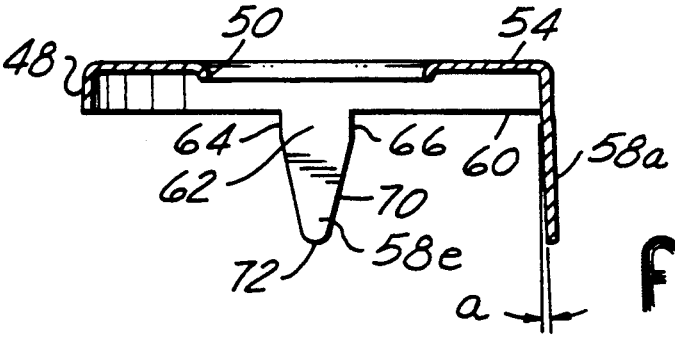
FIG. 5 is a cross-sectional view taken on the line 5—5 of FIG. 4.

The upper annular surface 54 and the lower annular surface 56 of the cap define the plane of the cap and a plurality of equiangularly spaced prongs or teeth 58 extend downwardly substantially perpendicular to this plane as best shown in FIG. 5. The teeth are integral with the outer peripheral flange 48 and simply extend downwardly therefrom in the same general direction. At the lower edge 60 of the outer peripheral flange, where the teeth commence, i.e. in the root or proximal area 62, they may be angled slightly outwardly as at a. Also, in the root area, each tooth has, in plan view, parallel edges 64 and 66 which extend downwardly and then converge as at 68 and 70 to a point 72 at the distal end. I have found that point 72 need not be sharp but may be slightly rounded as shown and will still penetrate several layers of fabric without difficulty. In fact, a slightly rounded point will not tend to cut the fabric as much as a sharp point but instead tends to simply push aside the fabric thus not seriously adversely effecting its tear strength.

As will be noted in FIG. 4, the inner periphery 46 of the cap is interrupted by a radially extending notch 74 having a semicircular closed end 76. This notch provides means for angularly polarizing the cap in the setting tool as hereinafter explained.

While the cap may be formed of any suitable material, such as brass, bronze, aluminum, steel, titanium or the like, I have found that stainless steel in the 300 series functions very well, and specifically 305 stainless. With a tooth cap having an outside diameter of 0.930 inches and an inside diameter of 0.500 inches and teeth 0.270 inches long (measured from the edge of the outer peripheral flange at the root of the tooth), I have found during limited testing that the stainless steel may be 0.016 inches thick.

I have shown the tooth cap as being annular but the central aperture defined by the inner periphery 46 may be omitted if desired such that the cap has a continuous crown across its diameter. This may be desired in certain instances, and if desired, identifying indicia may be stamped on such crown.

Figure 2:
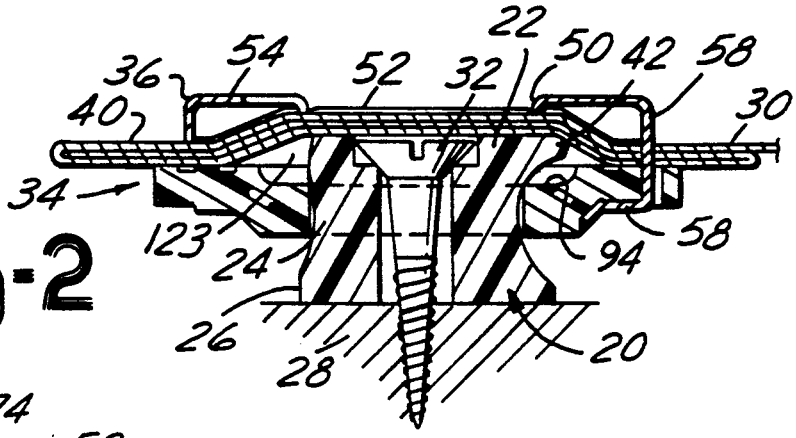
FIG. 2 is a cross-sectional view taken on the line 2—2 of FIG. 1.
Figure 3:
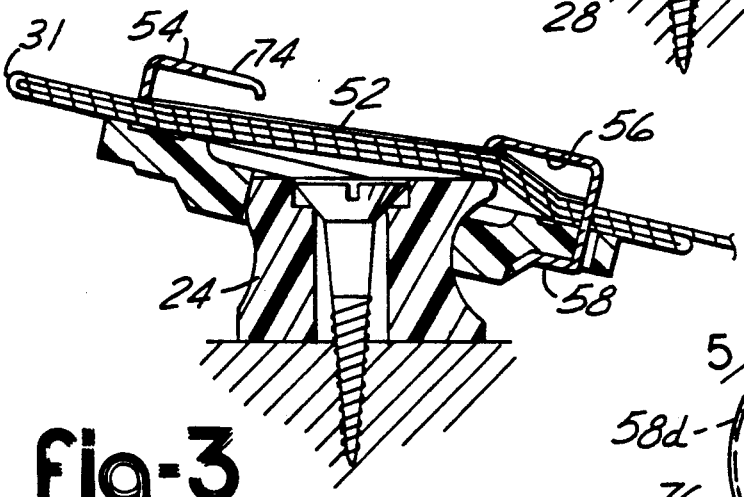
FIG. 3 is similar to FIG. 2 except the fastener is shown with the retainer in the act of being mounted on the stud.
Figure 7:
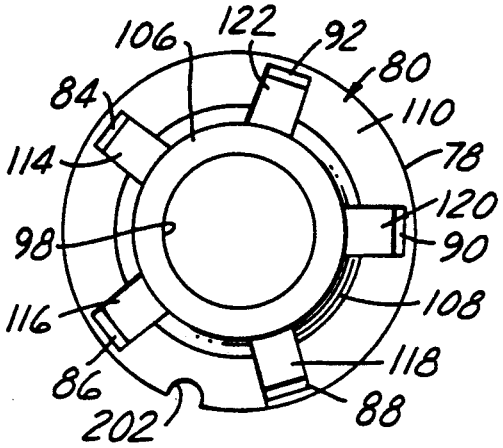
FIG. 7 is a plan view of the lower surface of the retainer.
Figure 6:
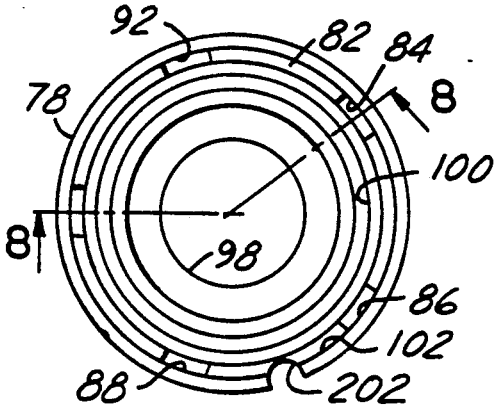
FIG. 6 is a plan view of the upper surface of the retainer.
Figure 8:
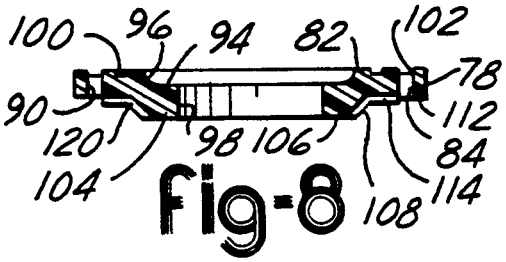
FIG. 8 is a cross-sectional view taken on the line 8—8 of FIG. 6.
Figure 9:
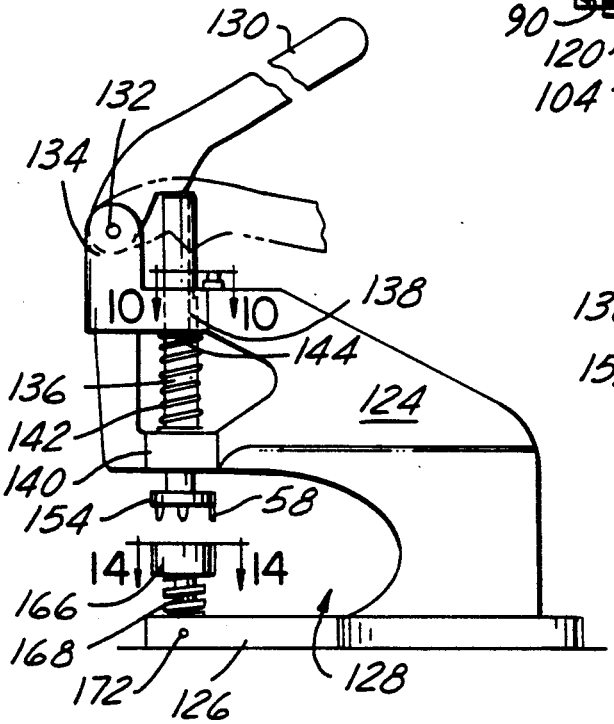
FIG. 9 is a side elevation of a press for assembly the tooth cap and retainer to the marginal edge of a fabric (not shown)
Figure 10:
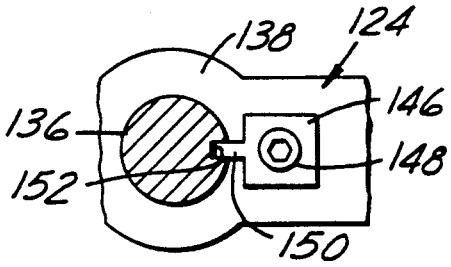
FIG. 10 is a cross-sectional view taken on the line 10—10 of FIG. 9.
Figure 11:
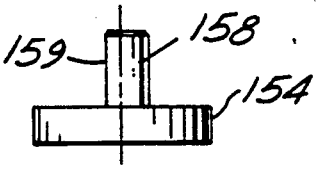
FIG. 11 is a side elevation of the upper die member.
Figure 12:
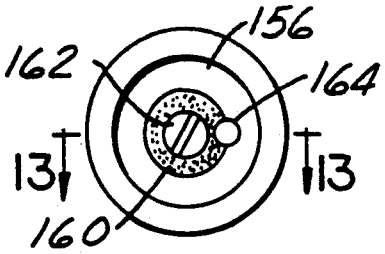
FIG. 12 is a bottom view looking up into the socket of the upper die member.
Figure 13:
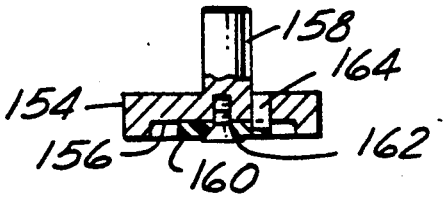
FIG. 13 is a cross-sectional view taken on the line 13—13 of FIG. 12.
Figure 14:
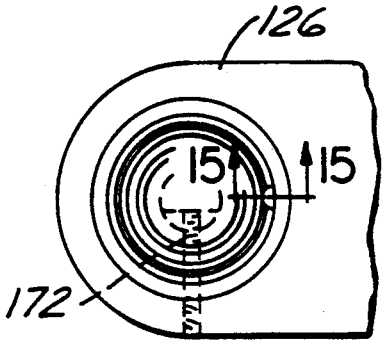
FIG. 14 is a top view looking down into the socket of the lower die.

The retainer member 38 shown best in Figures 6–8 is circular in plan view having an outer peripheral edge 78. For convenience, the annular surface 80 of the retainer which faces away from the fabric is shown in FIG. 7 and referred to as the lower surface while the surface 82 facing the fabric is shown in FIG. 6 and referred to as the upper surface. Both surfaces are interrupted by five equiangularly spaced apart slots 84, 86, 88, 90 and 92 extending completely through the retainer member adjacent the outer periphery 78, and each adapted to receive a tooth of the cap as shown in FIGS. 2 and 3.

As shown in cross-section in FIG. 8, the retainer member is generally dish-shaped having a somewhat concave-convex form, the concavity being defined by an annular recess 94 having an outer periphery 96 smoothly curving up to the surface 82 and an inner periphery terminating at a central aperture 98. In one embodiment, this aperture is 0.438 inches in diameter, and the recess 94 is 0.035 inches deep and the curvature at the periphery is on a radius of 0.40 inches. A pair of concentric grooves 100 and 102 encircle the central aperture in upper face 82 of the retainer member. These grooves serve to conserve plastic and give the surface 82 a ribbed configuration which bears against the fabric 30 to increase the grip of the retainer to the fabric. The slots 84–92 open through the bottom of groove 102. Desirably the slots are sized in angular length to essentially match the width between edges 64 and 66 of the teeth in the root area 62 so that the teeth essentially broach through the slot to provide a snug non-rotating fit between the cap and retainer members.

The lower surface 80 of the retainer member is shown in FIGS. 7 and 8 as provided with a raised or convex portion 104 having an annular surface 106 extending radially outwardly from the central aperture 98 to a sloping annular surface 108 which terminates outwardly in a flat concentric surface 110. To conserve material, this surface 110 may be stepped down as at 112 adjacent the outer periphery 78.

Extending radially inwardly from the slots are shallow grooves 114, 116, 118, 120 and 122 which terminate at the annular surface 106 and are adapted to receive the teeth 58 of the cap when they are clinched around and against the lower surface 80 of the retainer. Desirably such grooves should be substantially the same as or slightly deeper than the thickness of the teeth so that when the teeth are clinched against the lower surface, they will lie flush thereagainst within the surfaces 110 and 108 so that the clinched teeth will not offer undesirable protrusions on the lower surface of the retainer member. In addition, the length of the grooves 114–122 should be such as to accommodate the clinched length of the teeth in thin or thick fabric. I have found that when configured as shown, the cap and retainer will properly accommodate between them from two to six thicknesses of fabric and house the teeth in the grooves quite satisfactorily, as shown in FIGS. 2 and 3.

It will be noted that the size of aperture 98 is wholly independent of the securement of the retainer member 38 to the fabric, unlike the apertures of U.S. Pat. Nos. 4,409,706, 4,577,376, 4,646,399 and the disclosure of U.S. application Ser. No. 382,666, now U.S. Pat. No. 5,050,279. As a result of the present construction, the size and shape of the aperture 98 may be closely held with acceptable tolerances so that a snap fit on the stud is assured. It will also be noted that the edge 98 of the central aperture where it opens through surfaces 94 and 108 are not radiused. At this point in the development, I believe this design is best to assure a snap action for a long useful life of the fastener.

The retainer member may be formed of any plastic material which is firm, but resiliently extendable. When plastic is used it should contain an ultraviolet inhibitor. I have found that Nylon 66 or Celcon or an equivalent with an ultraviolet inhibitor is quite satisfactory. The stud may also be made of the same or a similar material which should be firm, but stiffly, elastically compressionable.

The retainer and cap members may be assembled to a fabric by hand using the simplest of tools, but preferably are assembled using a press and setting tools as hereinafter disclosed to give the tightest and best crimp. To assemble the components by hand, the preferred technique is to lay the marginal edge of the fabric 30 on a soft wood block (not shown) with the inside surface of the fabric against the wood. A tooth cap member 36 is then positioned over the fabric opposite the block with the teeth resting on the fabric at the location for the fastener, and with the cap rotated so that the notch 74 is adjacent the fabric edge 31, as in FIG. 1. If desired, identification or locating disk 52 may have been previously affixed to the fabric to locate the position of the tooth cap. The tooth cap is, of course, located directly over this identification disk. A second wooden block is then placed flush on top of the cap and struck a sharp blow with a hammer to drive the teeth through the fabric. The fabric is then reversed on the wooden block and a retainer member 38 aligned with the projecting cap teeth and pressed down firmly against the fabric to squeeze the fabric between the cap and retainer. While thus holding the retainer, the teeth projecting up through the slots 84–92 are bent over and clinched into the grooves 114–122 using, for example, a small ball-pean hammer. The grommet assembly is thus securely attached to the fabric.

As best shown in FIG. 2, when the tooth cap 36 and retainer 38 are assembled as above described on the fabric 30, they define between them a recess 123 through which the fabric extends and within which, and below the fabric, the head 22 of the stud is disposed. It will be noted that the head 22 of the stud displaced the fabric upwardly slightly and squeezes it against the inner peripheral flange 50 to give a tight fitting appearance between the fabric and the tooth cap at the cap aperture 47. During connection or disconnection between the stud and retainer, the fabric is displaced as shown in FIG. 3.

As shown in FIGS. 9–18, a press and setting tools may be utilized to quickly and even more securely attach the grommet assembly to the fabric. This tooling has the advantage that the cap and retainer are rotatably oriented in the correct position relative to the edge of the fabric so that the notch 74 will be adjacent the edge, and the parts are secured together tightly, quickly and uniformally. This tooling is desirable for use in a production environment as in a canvas maker's shop.

The tooling comprises a press body 124 of cast iron or the like having a base 126, a throat 128, an actuating handle 130 pivoted at 132 between a pair of ears 134 (only one of which is shown) integral with the body, a press plunger 136 reciprocable in aligned bearings (not shown) in portions 138 and 140 of the body, the upper end of the plunger abutting the handle to be driven down thereby, and a coil compression spring 142 encircling the plunger and abutting at its upper end a pin 144 secured in the plunger and at its lower end, portion 140 of the press body, to return the plunger and handle upwardly. The plunger is rotatably fixed by a keeper member 146 secured to the press body by a bolt 148 and having a finger 150 slidably received in an elongated slot 152 paralleling the axis of the plunger.

Fixed against rotation on the lower end of the plunger is a tooth cap receiving die 154 best shown in FIGS. 11–13 and 16. This die has an outwardly opening socket 156 sized to receive the tooth cap 36 with its teeth 58 projecting downwardly. The die has an integral stub shaft 158 on one side of which is a flat 159. The shaft is slidably received in the lower end of the plunger 136, and a set screw 137 in the side of the plunger abuts flat 159 to lock the die on the plunger in a specified angular position. Within the socket 156 are means for temporarily retaining the tooth cap against gravity and polarizing it. Such means comprise an elastomeric disk 160 sized to snugly fit within the central aperture 47 of the cap and held in the socket by a flat head screw 162 which, upon tightening, will serve to radially expand the disk and increase the tightness of the fit on the cap. Extending down through the disk is a short pin 164 pressed into the die and sized to fit the semicircular notch 74 in the cap. The set screw 137 is angularly positioned in the plunger so that when bearing against flat 159, the pin 164 will be disposed to position the tooth cap 36 with its notch 74 disposed closest to the edge 31 of a fabric received in the throat of the press. Thus, a canvas maker need merely insert the fabric into the press with the edge 31 of the fabric disposed within the throat, 128 and this will assure that the notch in the cap will be disposed adjacent the edge 31 of the fabric.

Figure 15:
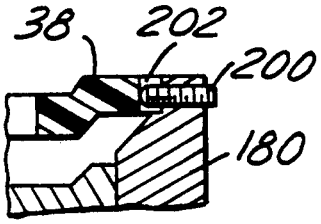
FIG. 15 is a cross-sectional view taken on the line 15—15 of FIG. 14.
Figure 16:
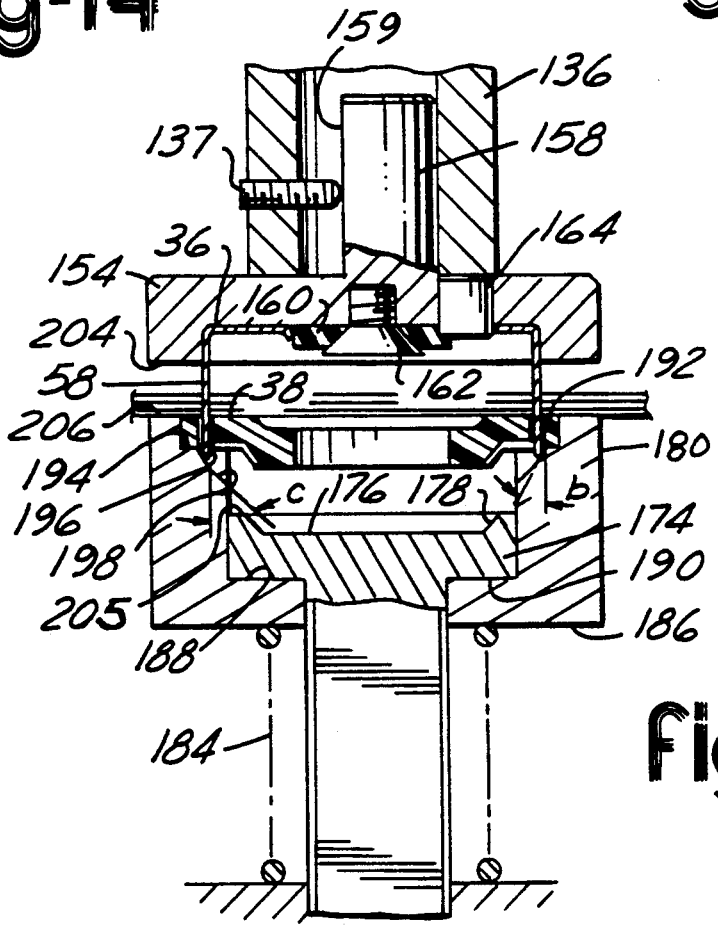
FIG. 16 is a side elevation, partially in section, through the upper and lower dies and associated mechanism of the press of FIG. 9 with the dies closed sufficiently so that the prongs of the tooth cap extend through the retainer and prior to any bending of the prongs.
Figure 17:
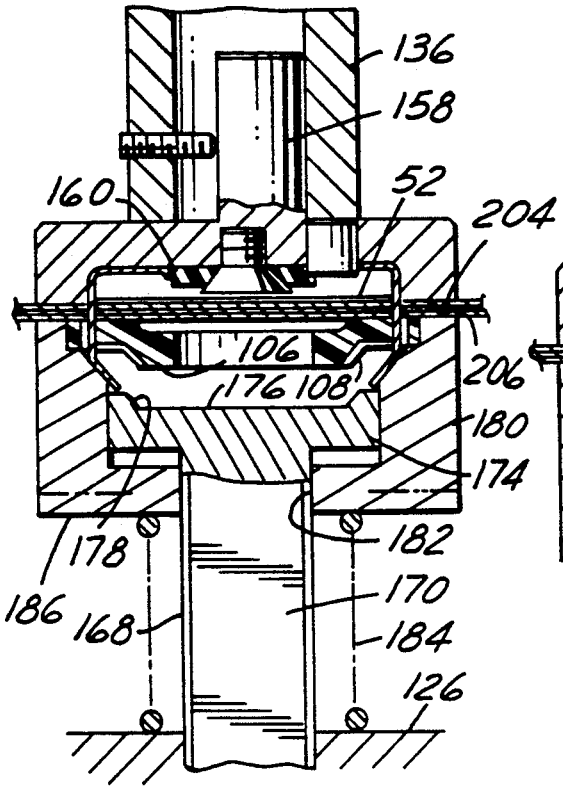
FIG. 17 is similar to FIG. 16 except the dies have closed sufficiently so that the fabric is slightly squeezed therebetween and the prongs have begun to be clinched.
Figure 18:
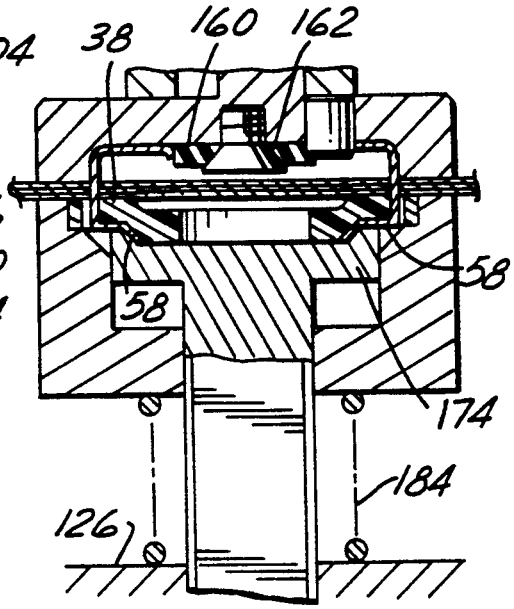
FIG. 18 is similar to FIG. 16 except the die members have fully closed to clinch the prong's lower surface of the retainer.

Disposed in aligned opposition to the upper die is a second or lower die 166 best shown in FIGS. 14–18 having a socket opening toward the socket in the first die 154 for receiving therein the retainer member 38. Die 166 comprises a central stem portion 168 of cylindrical configuration having a flat 170 along one side. At the lower end, the stem is received in the base 126 and a set screw 172, shown in FIGS. 9 and 14, in the base engages the flat 170 to lock the stem in the base and prevent rotation thereof. The upper end of stem 168 has a circular head portion 174 having a depressed flat upper surface 176 surrounded by an annular angled surface 178 which matches the sloping annular surface portion 108 of the retainer as best shown in FIGS. 16–18. Surface 176 is flat to match the annular surface portion 106 on the bottom face of the retainer and has a diameter also matching the outer peripheral diameter of annular surface 106. Thus, when stem head 174 is pressed upwardly against the retainer 38, it is configured to match the lower surface profile thereof.

Stem 168 and head 174 are is surrounded by a die member housing 180 which has a D-shaped aperture 182 which matches the shape of the stem and its flat surface . 170 such that the housing 180 while free to slide on the stem is restrained against relative rotation. A coil compression spring 184 encircles the stem and bears at its upper end against the underside 186 of housing 180 and at its lower end against base 126. Spring 184 urges the housing 180 upwardly so that the housing surface 188 bears against the underside 190 of the head 174. Housing 180 provides an outwardly opening socket 192 axially aligned with and opposing the downwardly opening socket in the first die member 154. Socket 192 is intended to support and embrace the retainer 38. A retainer supporting surface 194 underlies the marginal edge of surface 80 of the retainer to support the same in the socket. Surface 194 terminates inwardly at a downwardly inclined annular surface 196, having an angle b of inclination with respect to the vertical which is equal to approximately 30°. The surface 196 extends downwardly to a second surface 198 which is an annular surface inclined inwardly at an angle of substantially 45° as indicated by reference character c in FIG. 16. The surfaces 196 and 198 may be formed of tool steel hardened to 60 Rockwell and serve to sequentially engage and bend the teeth 58 around the retainer.

As shown in FIG. 15, the socket 192 of the second die member is provided with means for angularly polarizing the retainer when disposed in the socket. Such means comprises a set screw 200 or the like radially threaded through the wall of the housing 180 and having a rounded end for reception in the peripheral notch 202 of the retainer. Pin 200 is angularly located on the housing such that the slots 84–92 in the retainer are aligned with the teeth 56 of the tooth cap when the tooth cap is received in the socket of the first die member. Thus, when the die members are moved toward each other, with a tooth cap in the upper one and a retainer in the lower one, the teeth 58 will enter the slots of the retainer as shown in FIG. 16.

After the teeth 58 have passed through the slots in the retainer, they engage the first annular surface 196 and are inwardly deflected as the upper die moves toward the lower die. The spring 184 is sized to maintain the housing 180 of the lower die in its uppermost position shown in FIG. 16 while the teeth are bent inwardly by the surface 196 and as they slide downwardly and are further bent inwardly by the surface 198. The lower die housing 180 has an upper annular surface 206 which is disposed in opposition to the downwardly facing annular surface 204 of the upper die member 154. Surface 206 supports the fabric on top of the lower die member as the teeth 58 are being pressed through the slots in the retainer. The depth of socket 156 in the upper die 154 is slightly shallower than the depth of the tooth cap measured from the upper surface 54 to the edge 60 of the peripheral flange 48 such that when the upper and lower dies of the press are moved toward each other sufficient to begin to move housing 180 down along the stem 168 of the lower die member, the fabric is tightly gripped between the surfaces 204 and 206 of the dies and the outer peripheral flange 48 is tightly pressed against the upper surface of the fabric. As a consequence, the fabric is pressed tightly against the upper surface 82 of the retainer at the time that the teeth 58 are crimped around and against the retainer. As a result, it is possible to get a much tighter connection between the cap, the retainer and the fabric than when the components are assembled by hand as first described above.

As the teeth 58 sequentially slide down surface 196 and then surface 198, the housing 180 begins to be depressed downwardly along the stem such that upper annular surface 205 of the head 174 engages the teeth and clinches them upwardly and against the bottom of the grooves 114–122, aided in this by the annular surface 178 of the head such that upon completion, the teeth are clinched and deformed against the retainer as shown in FIG. 18. In FIG. 18, the compression spring 184 is shown compressed to its greatest extent.

In operating the press and tooling above described in connection with FIGS. 16–18, it will be understood that the tooth cap and retainer are clinched together through the fabric in one smooth continuous motion. First the retainer is positioned on one side of the fabric in the lower die. The tooth cap is positioned on the opposite side of the fabric in the upper die axially aligned with the retainer and with, the teeth projecting toward the fabric and retainer. Then, in a single motion, the workman swings handle 130 downwardly and presses the teeth 58 through the fabric and through the retainer and clinches them against the opposite side of the retainer. Because of the polarization of the cap and retainer in the dies, the prongs pass smoothly through the slots in the retainer prior to clinching.

Figure 19:
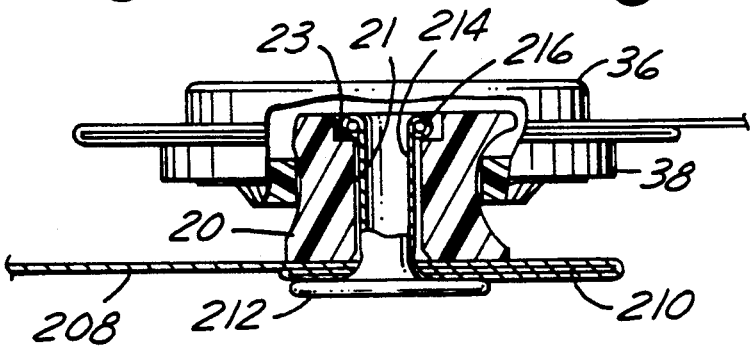
FIG. 19 is a cross-sectional view of my snap fastener in which the stud is mounted on a fabric in a fabric to fabric snap fastener connection.

In FIG. 19, I have shown the manner in which the stud 20 may be mounted on a fabric 208 where it is desired to establish a snap fastened fabric to fabric connection. In this case, the fabric 208 becomes the equivalent of the support 28 in FIG. 2. The fabric may be doubled upon itself or hemmed or otherwise reinforced as at 210. A conventional tubular rivet having an enlarged head 212 is inserted through the hem area 210 such that the tubular stem 214 of the rivet extends through the fabric and up through the bore 21 in the stud and is then upset as by being rolled over as at 216 against the bottom 23 of the counterbore in the head of the rivet.

What is claimed is:

1. A snap fastener for holding a fabric to a support comprising, in combination:

a stud having a relatively rigid pear shaped head and a shank for mounting to a support with the head uppermost;

a relatively rigid retainer having an aperture sized for snapping reception in one direction over the head of the stud and retention against removal except in said one direction;

a cap having a crown and a plurality of spaced apart prongs extending substantially perpendicular to the crown; said crown positionable on one side of a fabric and said retainer positionable on the opposite side of such fabric with said prongs extendable through the fabric and clinchable around and over the retainer independently of said aperture on the opposite side from said fabric to hold the fabric securely between the retainer and the crown with the fabric extending uninterruptedly over the head of the stud and held on the support to which the stud is mounted.

2. The invention defined by claim 1 wherein said stud is formed of a firm but elastically compressible plastic, and said retainer is formed of a firm but resiliently extendable plastic.

3. The invention defined by claim 1 wherein said cap is formed of a stiffly resilient metal taken from the group consisting of brass, bronze, aluminum, steel, titanium and stainless steel.

4. The invention defined by claim 1 wherein said retainer is formed of a firm, but resiliently extendable plastic.

5. The invention defined by claim 1 wherein said retainer is circular and said prongs are arranged in a circular pattern to overlie the retainer adjacent the periphery thereof.

6. The invention defined by claim 5 wherein said retainer has prong receiving recesses adjacent the periphery and said prongs are receivable through said recesses for clinching against the periphery of the retainer.

7. The invention defined by claim 1 wherein the retainer and cap define therebetween a stud head receiving cavity and a fabric to which the fastener is secured extends through the cavity to overlie a stud head disposed in the cavity when the retainer is retained on the stud.

8. The invention defined by claim 1 wherein said crown is of annular configuration.

9. The invention defined by claim 8 wherein said crown has an outer periphery and an inner periphery, and said prongs are disposed at the outer periphery.

10. The invention defined by claim 9 wherein said crown has a peripheral flange disposed at the outer periphery and substantially perpendicular to the plane of the crown and extending in the same direction as said prongs.

11. The invention defined by claim 9 wherein said crown has a peripheral flange disposed at the inner periphery.

12. The invention defined by claim 8 further comprising an identification disk disposed within the crown between the crown and the fabric through which the prongs are projected wherein the crown has an open center through which the disk is visible.

13. The invention defined by claim 12 wherein identifying indicia are disposed on the identification disk and visible through the open center of the crown.

14. The invention defined by claim 1 wherein said crown has a peripheral flange extending away from the crown in the same direction as said prongs, and said retainer has a generally planar face portion opposed to said crown and a groove in said face portion in registering opposition to said flange.

15. The invention defined by claim 1 wherein said retainer is generally circular and has an outer periphery and said crown is generally circular with said prongs disposed at the periphery thereof, and said retainer is generally planar with oppositely directed faces having one face opposed to the fabric and the other directed away from the fabric, and said retainer has prong receiving slots at the outer periphery thereof, registering with the crown prongs, and said retainer has prong receiving grooves in said other face extending radially inwardly from said slots toward said aperture, said grooves having a depth at least equal to the thickness of the crown prongs and a length to accommodate the length of the prongs when clinched over the retainer.

16. The invention defined by claim 1 wherein said crown has a circular annular disk portion and an outer peripheral edge and said prongs are disposed at said outer peripheral edge.

17. The invention defined by claim 16 wherein said outer peripheral edge is provided with a flange extending substantially perpendicular to the cap.

18. The invention defined by claim 1 wherein said prongs are each provided with a distal end having a rounded point projectable through the fabric and the retainer.

19. The invention defined by claim 1 wherein said retainer is provided with angularly spaced apart prong receiving slots and has means for rotatably polarizing the retainer.

20. The invention defined by claim 19 wherein said cap exhibits means for rotatably polarizing it whereby the prongs of the cap and slots of the retainer may be angularly aligned.

21. A grommet assembly for a snap fastener comprising, in combination:

a cap having a crown of circular configuration with an outer peripheral edge and a plurality of angularly spaced apart resistingly bendable teeth extending substantially perpendicular to the crown; and a relatively rigid circular retainer of generally annular plate shape having a pair of opposed faces with an outer peripheral edge, a central aperture sized for snapping reception in one direction over the head of a stud and retention against removal except in said one direction, a plurality of angularly spaced apart slots extending completely through the retainer adjacent the outer periphery thereof in corresponding angular relation to the teeth of said crown and a plurality of radical grooves formed in one of said faces and extending inward from each slot toward the central aperture and having a depth to accommodate in flush mating engagement teeth of the cap extending through the slots and clinched against the surface of the retainer within the grooves.

22. The invention defined by claim 21 wherein said cap is formed of metal.

23. The invention defined by claim 22 wherein said metal comprises stainless steel.

24. The invention defined by claim 21 wherein said cap and said retainer are each provided with means for polarizing the cap and the retainer so that the teeth and slots may be properly angularly aligned during installation.

25. A retainer member for cooperation with a tooth cap of a snap fastener grommet assembly, comprising:

a circular relatively rigid plate-like member having opposed oppositely facing surfaces with an outer peripheral edge and a central aperture defining an inner peripheral edge;

said member having on one of said surfaces a circular groove concentric to said aperture;

a plurality of circumaxial spaced apart slots extending through the member from one surface to the other in alignment with and for reception of the teeth of a cap; and a plurality of radial grooves in that surface of the member opposite the surface containing the circular grooves, extending from each slot toward the central aperture and having a width and a depth to receive in substantially flush mating engagement the teeth of a toothed cap bent over and clinched against such surface of the member within the radially extending grooves.

26. The invention defined by claim 25 wherein the cap is formed of stainless steel.

27. The invention defined by claim 25 wherein said retainer is provided with means for polarizing the retainer to facilitate the alignment of the slots in the retainer with the teeth of the tooth cap during grommet assembly.

* * * * *